United States Patent [19]

Mørup

[11] 4,180,764

[45] Dec. 25, 1979

[54] CONTROL CIRCUIT FOR AN A.C. DISCHARGE LAMP

[75] Inventor: Poul Mørup, Vaerløse, Denmark

[73] Assignee: Alex Grosman A/S, Herlev, Denmark

[21] Appl. No.: 903,883

[22] Filed: May 8, 1978

[30] Foreign Application Priority Data

Nov. 16, 1977 [DK] Denmark ..... 5084/77

[51] Int. Cl.[2] ..... H05B 41/36

[52] U.S. Cl. ..... 315/283; 315/244; 315/284; 315/291; 315/311; 315/DIG. 7; 323/76; 323/83

[58] Field of Search ..... 315/278, 282, 283, 284, 315/291, 307, 311, DIG. 4, DIG. 7, 227 R, 244; 323/89 A, 82, 83, 76, 7

[56] References Cited

U.S. PATENT DOCUMENTS

| | | | |
|---|---|---|---|
| 2,665,394 | 1/1954 | Arvidsson et al. | 315/284 X |
| 2,961,579 | 11/1960 | Roney et al. | 315/284 X |
| 3,599,037 | 8/1971 | Grace | 315/284 X |

FOREIGN PATENT DOCUMENTS

| | | | |
|---|---|---|---|
| 2444219 | 3/1976 | Fed. Rep. of Germany | 315/291 |

*Primary Examiner*—Eugene R. LaRoche
*Attorney, Agent, or Firm*—Flehr, Hohbach, Test, Albritton & Herbert

[57] ABSTRACT

A control circuit comprising a series transductor coupled between an A.C. source and an A.C. discharge lamp. The control windings of the series transductor are connected to the A.C. source through a filter, a full-wave rectifier, and a substantially capacitive impedance. As a result the total reactive effect is reduced.

3 Claims, 4 Drawing Figures

CONTROL CIRCUIT FOR AN A.C. DISCHARGE LAMP

BACKGROUND OF THE INVENTION

The invention relates to a control circuit for an A.C. discharge lamp and comprising a series transductor coupled between the A.C. source and the lamp.

Danish Pat. specification No. 74,878 discloses a system with neon tubes for stage lightning. This system comprises a transductor connected in series with the neon tube, said transductor permitting control of the current supplied to the neon tube. This transductor implies, however, a rather significant reactive effect.

SUMMARY AND OBJECTS OF THE INVENTION

The control circuit according to the invention is characterized by the control windings of the series transductor being connected to the A.C. source through a filter, a full-wave rectifier, and a substantially capacitive impedance.

As a result it is possible to minimize the total reactive effect by an appropriate choice of the ratio in the series transductor.

It is preferred that the capacitive impedance comprises a variable device.

Since the currents are of the magnitude 10 A, a general variable capacitor is not sufficient. The variable device may, however, be a variable transformer in connection with a capacitor, whereby the current intensity may be transformed to a desired level at the same time as the desired variation possibility is obtained.

The invention will be described below with reference to the accompanying drawing, in which

DESCRIPTION OF THE PREFERRED EMBODIMENTS

Figure 1:
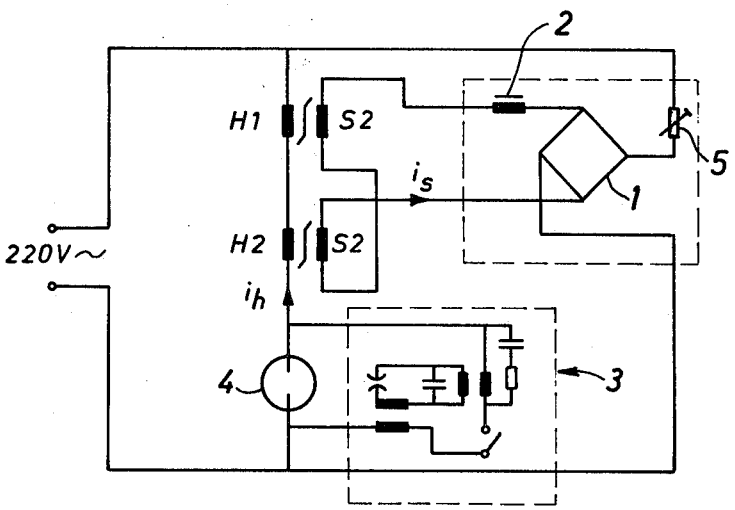
FIG. 1 is a schematic diagram depicting the control circuit according to the invention for an A.C. discharge lamp.
Figure 2A:
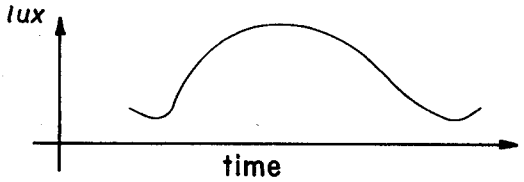
FIG. 2*a* is a graph depicting the light intensity as a function of time for a discharge lamp directly connected to a main power supply.
Figure 2B:
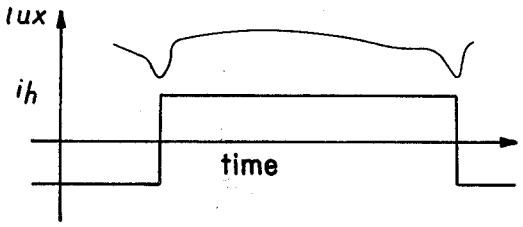
FIG. 2*b* is a graph depicting the light intensity as a function of time for a discharge lamp connect to the control circuit of FIG. 1.

FIG. 1 illustrates a control circuit for an A.C. discharge lamp 4. This control circuit comprises a series transductor H1, S1, H2, S2. Through the transductor, the lamp 4 is directly connected to the AC mains shown as 220V. A control circuit $i_s$ is supplied to the control windings S1, S2 of the series transductor through a full-wave rectifier 1 which also connected to the AC mains. The control current involves a rectangular current through the main windings H1, H2, as the load of the windings is ohmic. The amplitude of the rectangular current is determined by the control current $i_s$. The load is, however, not quite ohmic since the characteristic of the discharge lamp 4 with the voltage plotted as function of the current intensity $i_h$ at first is increasing, and then substantially constant (at about 100 V), and finally rapidly increasing. A surprising feature is that the current nevertheless is substantially rectangular. In this manner the light intensity $i_{ux}$ is substantially constant too, as shown in FIG. 2*b*, apart from the moments of commutation. The deviations from the constant light intensity—apart from the moments of commutation—are due to ripple voltages in the control current $i_s$. This ripple voltage can, however, be reduced by means of a filter 2, whereby a constant light intensity is obtained.

A conventional ignition circuit 3 is connected to the lamp 4.

It is preferred to use a non-linear component, optionally in connection with a transformer for the control of the control current $i_s$. Such a non-linear component only permits passing of a current of a predetermined magnitude, whereby the control circuit is independent of variations in mains voltage.

The commutation of the rectangular current is shifted about a quarter of a period compared to the zero point of the sinusoidal current.

By means of a variable impedance 5 in the form of a variable capacitive device for the control of the control current $i_s$, it is possible to compensate for the phase shift when the ratio of the transductor is 1:1. As the control circuit as a consequence of the ratio of 1:1 always loads with a current from the mains, which is substantially equal to the current to the main circuit. The fact that the current through the control circuit is shifted substantially half a period compared to the current through the main circuit provides a reduced reactive effect loss.

The invention thus illustrates a manner of utilizing the properties of the series transductor so as to minimize the reactive effect irrespective of the load.

Figure 3:
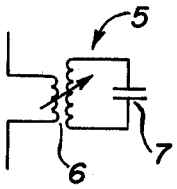
FIG. 3 is a schematic diagram depicting one type of variable capacitive device in an alternative embodiment of the control circuit of the invention.

The variable capacitive device 5 may for instance be a variable transformer 6 in connection with a permanent capacitor 7 as depicted in FIG. 3.

The constant light intensity which is obtained without reactive effect loss is, for instance, of importance for stage lightning for the shooting of films, especially at shootings with abnormal and varying frames per second.

The control circuit according to the invention may be varied in many ways without deviating from the scope of the invention.

The reactive effect can, of course, only be minimized as far as the fundamental frequency of the rectangular wave is concerned.

The shift of the commutation compared to the zero point of the sinusoidal voltage depends on the curve voltage of the lamp, and is not necessarily exactly a quarter of a period.

It is, however, possible to compensate for a deviation from the quarter of a period by adjusting the ratio of the transductor. The ratio as function of the shift may be provided either by tests or by simple calculations.

Irrespective of the magnitude of the ratio, it is still the characteristics of the transductor that are utilized, i.e. the fact that the ratio of the control circuit to the main current is constant.

I claim:

1. A control circuit for an A.C. discharge lamp (4) comprising a series transductor having control windings (S1, S2) coupled between the A.C. source and the lamp (4), the control windings (S1, S2) of the series transductor being connected to the A.C. source through a filter (2) and a full-wave rectifier (1), and a substantially capacitive variable impedance (5) in the control winding circuit.

2. A control circuit as in claim 1 in which the capacitive variable impedance (5) is a variable transformer (6) in parallel connection with a capacitor (7).

3. A control circuit as claimed in claim 2, characterized by the variable device being a variable transformer (6) in connection with a capacitor (7).

* * * * *